US008678085B1

(12) United States Patent
Mouton

(10) Patent No.: US 8,678,085 B1
(45) Date of Patent: Mar. 25, 2014

(54) WELL CONTROL OPERATIONAL AND TRAINING AID

(76) Inventor: David E. Mouton, Houston, TX (US)

( * ) Notice: Subject to any disclaimer, the term of this patent is extended or adjusted under 35 U.S.C. 154(b) by 480 days.

(21) Appl. No.: 12/963,973

(22) Filed: Dec. 9, 2010

Related U.S. Application Data

(60) Provisional application No. 61/286,209, filed on Dec. 14, 2009.

(51) Int. Cl.
*E21B 43/12* (2006.01)
*E21B 21/08* (2006.01)

(52) U.S. Cl.
CPC ..... *E21B 43/12* (2013.01); *E21B 21/08* (2013.01)
USPC ..... 166/250.15; 166/386; 166/250.07; 175/24

(58) Field of Classification Search
USPC ..... 166/250.15, 53, 386, 66, 250.07; 175/24
See application file for complete search history.

(56) References Cited

U.S. PATENT DOCUMENTS

| | | | | |
|---|---|---|---|---|
| 3,827,511 | A | 8/1974 | Jones | |
| 3,971,926 | A | 7/1976 | Gau et al. | |
| 4,253,530 | A | 3/1981 | Sharki et al. | |
| 5,303,582 | A | 4/1994 | Miska | |
| 6,484,816 | B1 * | 11/2002 | Koederitz | 175/25 |
| 6,575,244 | B2 | 6/2003 | Chang et al. | |
| 7,261,168 | B2 | 8/2007 | McGregor et al. | |
| 7,610,251 | B2 | 10/2009 | Shayegi et al. | |
| 2005/0092523 | A1 | 5/2005 | McCaskill et al. | |
| 2005/0257611 | A1 | 11/2005 | Fogal et al. | |
| 2005/0257960 | A1 | 11/2005 | McGregor et al. | |
| 2007/0107938 | A1 | 5/2007 | Cornish et al. | |
| 2007/0168056 | A1 | 7/2007 | Shayegi et al. | |
| 2007/0227774 | A1 | 10/2007 | Reitsma et al. | |
| 2007/0246263 | A1 | 10/2007 | Reitsma | |
| 2008/0185143 | A1 | 8/2008 | Winters et al. | |
| 2008/0314137 | A1 | 12/2008 | Proett et al. | |
| 2009/0194330 | A1 | 8/2009 | Gray | |

* cited by examiner

*Primary Examiner* — Cathleen Hutchins
(74) *Attorney, Agent, or Firm* — Garvey, Smith, Nehrbass & North, L.L.C.; Gregory C. Smith; Julia M. Fitzpatrick

(57) ABSTRACT

A method and system to aid and/or train well control personnel by measuring the actual hydraulic delay and pressure attenuation of operator choke changes during well control operations or simulations. This provides the choke operator with an anticipated drillpipe pressure as soon as the choke is adjusted, accounting for hydraulic delay, pressure attenuation and prior choke adjustments that are currently travelling through the wellbore as well as reflections of the transient pressure waves against the pumps and choke. The technique that is described utilizes only three inputs, and works without knowledge of or inputting data such as well depth, pipe and hole geometry, mud properties, temperature, water depth, land, offshore platform or floating (subsea BOP's) drilling rigs.

8 Claims, 9 Drawing Sheets

WELL CONTROL OPERATIONAL AND TRAINING AID

CROSS-REFERENCE TO RELATED APPLICATIONS

Priority of U.S. Provisional Patent Application Ser. No. 61/286,209, filed Dec. 14, 2009, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus while drilling a well to aid a choke-operator during well control operations in achieving desired bottom-hole pressure. The invention calculates hydraulic time-delay and pressure attenuation, and includes provisions to account for numerous choke changes and pressure reflections within the hydraulic-delay period using only three inputs, regardless of well depth, pipe and hole geometry, mud properties, temperature, water depth, land, offshore platform or floating (subsea BOP's) drilling rigs.

2. General Background of the Invention

In most geologic basins of the world, drilling for commercial hydrocarbons presents a hazard by virtue of the desired prize itself—flammability of the oil and gas that is contained in the rock strata at high pressures. If these fluids are allowed to surface, they can wreck havoc on the drilling facility that has penetrated the zone. This particular event can be fatal to both rig personnel and neighboring residents.

Fortunately, the spectacular "blow-outs" of Spindletop and other boom areas in the early 1900's have been engineered to "well-control" events that can be "killed" by "well-kill" operations using the constant bottom-hole pressure method. This technique requires maintaining the drill-pipe pressure at given values during the course of the well "kill" which in turn ensures constant bottom-hole pressure at the bottom of the well. This concept is the singular premise of modern well-control to this day, and ensures that adequate pressure is maintained in the wellbore to prevent additional influx of hydrocarbons without fracturing the rock strata.

However, this premise dictates that the pressure on the drill-pipe must be maintained by adjustments on the "back side" or annulus, by suitable restrictions. This is accomplished by adjusting a "choke" mounted on a choke panel that provides back pressure to the circulating system.

It is critical to note that the most difficult aspect of the constant bottom-hole pressure method is maintaining a given pressure on the drill pipe by adjusting the choke on the annulus. This difficulty of maintaining pre-determined pressures is directly related to the hydraulic delay and attenuation of the choke change adjustment as it travels against the flow down the annulus, through the bit and up the drillpipe to the pressure gauge mounted on the choke manifold as per phenomena that is typically studied academically as 'waterhammer". This phenomena is not well understood even in this day and age 100 years after Spindletop; the established delay as taught by most well control schools is 2 seconds per 1,000' of drillpipe length; yet no provisions are made for oil-base vs. water base muds and/or brines. Further, the choke change may not produce the desired change in the drillpipe pressure due to the attenuation of the signal as it travels as much as several miles through the well. Reflections of the pressure wave against the pumps and choke due to choke manipulations are possible and therefore several transit times may be required for the system to stabilize.

The following U.S. Patents are incorporated herein by reference:

TABLE

| PAT. NO. | TITLE | ISSUE DATE |
|---|---|---|
| 3,827,511 | Apparatus for Controlling Well Pressure | Aug. 6, 1974 |
| 4,253,530 | Method and System for Circulating A Gas Bubble from a Well | Mar. 3, 1981 |
| 5,303,582 | Pressure-Transient Testing While Drilling | Apr. 19, 1994 |
| 6,575,244 | System for Controlling the Operating Pressures within a Subterranean Borehole | Jun. 10, 2003 |
| 7,261,168 | Methods and Apparatus for Using Formation Property Data | Aug. 28, 2007 |
| 7,610,251 | Well Control Systems and Associated Methods | Oct. 27, 2009 |
| 2005/0257611 | Methods and Apparatus for Measuring Formation Properties | Nov. 24, 2005 |
| 2007/0107938 | Multiple Receiver Sub-Array Apparatus, Systems, and Methods | May 17, 2007 |
| 2007/0227774 | Method for Controlling Fluid Pressure in a Dynamic Annular Pressure Control System | Oct. 4, 2007 |
| 2007/0246263 | Pressure Safety System For Use With a Dynamic Annular Pressure Control System | Oct. 25, 2007 |
| 2008/0097735 | System for Predicting Changes in a Drilling Event During Wellbore Drilling Prior To The Occurrence of The Event | Apr. 24, 2008 |
| 2008/0185143 | Blowout Preventer Testing System and Method | Aug. 7, 2008 |
| 2008/0314137 | Methods and Apparatus for Measuring Formation Properties | Dec. 25, 2008 |
| 2009/014330 | System, Program Products, and Methods for Controlling Drilling Fluid Parameter | Aug. 6, 2009 |

As above, there have been numerous efforts to improve the well control process; the particular ones listed below are the most pertinent to the present invention:

1. U.S. Pat. No. 3,827,511 discloses a semi-automatic controller that uses a downhole transducer to obtain bottom-hole pressures.
2. U.S. Pat. No. 4,253,530 discloses an automatic controller that utilizes comparators to effect choke changes to maintain desired drill pipe pressures.
3. U.S. Pat. No. 6,575,244 discloses an automated controller that uses lag compensation and/or feedforward control to maintain desired drillpipe pressures. It also describes a system whereby choke changes are initiated by a visual human feedback loop, but are actuated by the control system.

Fortunately, well control operations are not a common occurrence over the contract period of a particular rig working in a particular area. Therefore, it is difficult to justify and implement a complex control system on drilling rigs in general as described in the above prior art. For example, as control systems become more sophisticated, additional control parameters are introduced that need to be tested and adjusted for certain drilling fluids, influx types, well depths, hole geometry, mud type and properties, temperature profiles, etc. These systems are sometimes used on Managed Pressure Drilling Operations (MPD) but require dedicated personnel to operate and maintain. Since well control operations are not a regular event, it is difficult to impossible to fine-tune an un-manned control system that will react as reliably as a trained and competent human operator. Due to the critical nature and risk of the well control operation, human control will always be desired as crews are trained and certified in well control operations as required by most government agencies around the world.

In contrast to the prior art, the proposed invention provides a means to aid the well control operator to safely circulate out dangerous influxes from the wellbore by employing a device that only requires three inputs, eliminating the need for dedicated personnel to operate and maintain the system.

BRIEF SUMMARY OF THE INVENTION

The present invention provides information to the human operator to effectively control the choke to achieve desired drillpipe pressures. It does this by empirically calculating hydraulic delay and attenuation of choke pressure changes to provide the operator with an anticipated drillpipe pressure, accounting for multiple choke changes and pressure reflections from the pumps and choke that are still in the hydraulic system. The calculation method and required apparatus is simple and robust, allowing it to be used seamlessly as a regular tool in all areas of the world to ensure safety of rig and neighboring personnel.

The novelty of the technique and embodiment is due to the fact that only three parameters are used: Drillpipe pressure (DPP), Casing Pressure (CP) and Choke position. It is important to note that this data is commonly displayed in a dedicated instrument called a "Choke Panel", that is used chiefly for well control operations.

Therefore, the technique is easily integrated to the majority of drilling rigs operating in the world with the described embodiment mounted at the choke panel, without knowledge or input of well depth pipe and hole geometry, mud properties, temperature, water depth, land, offshore platform or floating (subsea BOP's). Further, since the above data is not needed, there is no need for support personnel to be present after the initial installation. This is in contrast to the systems described in the prior art whereby the above parameters are continuously inputted and updated to complete a hydrodynamic model, requiring human interaction on a continuous basis.

It is important to understand the human dynamics of the well-control operator while circulating out an influx from the formation or "kick":

A. The choke operator must maintain a pre-determined schedule of drillpipe pressures vs. volume of fluid pumped based on the depth and geometry of the well.
B. The drillpipe pressures are maintained by adjusting the choke on the annulus.
C. The choke operator waits until the choke adjustment has impacted the drillpipe pressure.
D. If required, the choke operator will make additional adjustments on the choke to maintain the desired drillpipe pressures.

Although the above directives appear straight-forward, there are several hydraulic phenomena that can make the task difficult:

1. The height of the gas bubble of the influx that is influenced by wellbore geometry, pressure and solubility of the kick in the fluid system.
2. The compliance of the open-hole annular hydraulic conduit.
3. Reflections of the pressure (water-hammer) wave against the pump and/or choke system.

The above factors can change the hydraulic delay or "lag time" of the response of the drillpipe pressure to the choke adjustment. When long or erratic hydraulic delays are encountered on deeper or complex wells, the choke operator has a tendency to make several choke adjustments prior to stabilization, resulting in over-compensation or "roller-coasting" the desired drillpipe pressure schedule. This can result in a fracturing of the rock strata if the pressure is too high or an additional influx can be introduced into the well bore if the pressure is too low. Both consequences severely complicate and compound the problem of killing the well, which further puts personnel and equipment at risk.

The present invention simply and robustly measures the actual hydraulic delay and attenuation to eliminate uncertainty and provides the choke operator with an anticipated drillpipe pressure as soon as the choke is adjusted, accounting for hydraulic delay, attenuation and prior choke adjustments that are currently travelling through the wellbore as well as reflections of the transient pressure waves against the pumps and choke. The unique and novel technique that is described utilizes only three inputs, and works without inputting data such as well depth, pipe and hole geometry, mud properties, temperature, water depth, land, offshore platform or floating (subsea BOP's) drilling rigs. Since this information is not required, the proposed system does not require on-site human monitoring and guidance for operation, unlike more complex systems that have been proposed or are currently in use.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
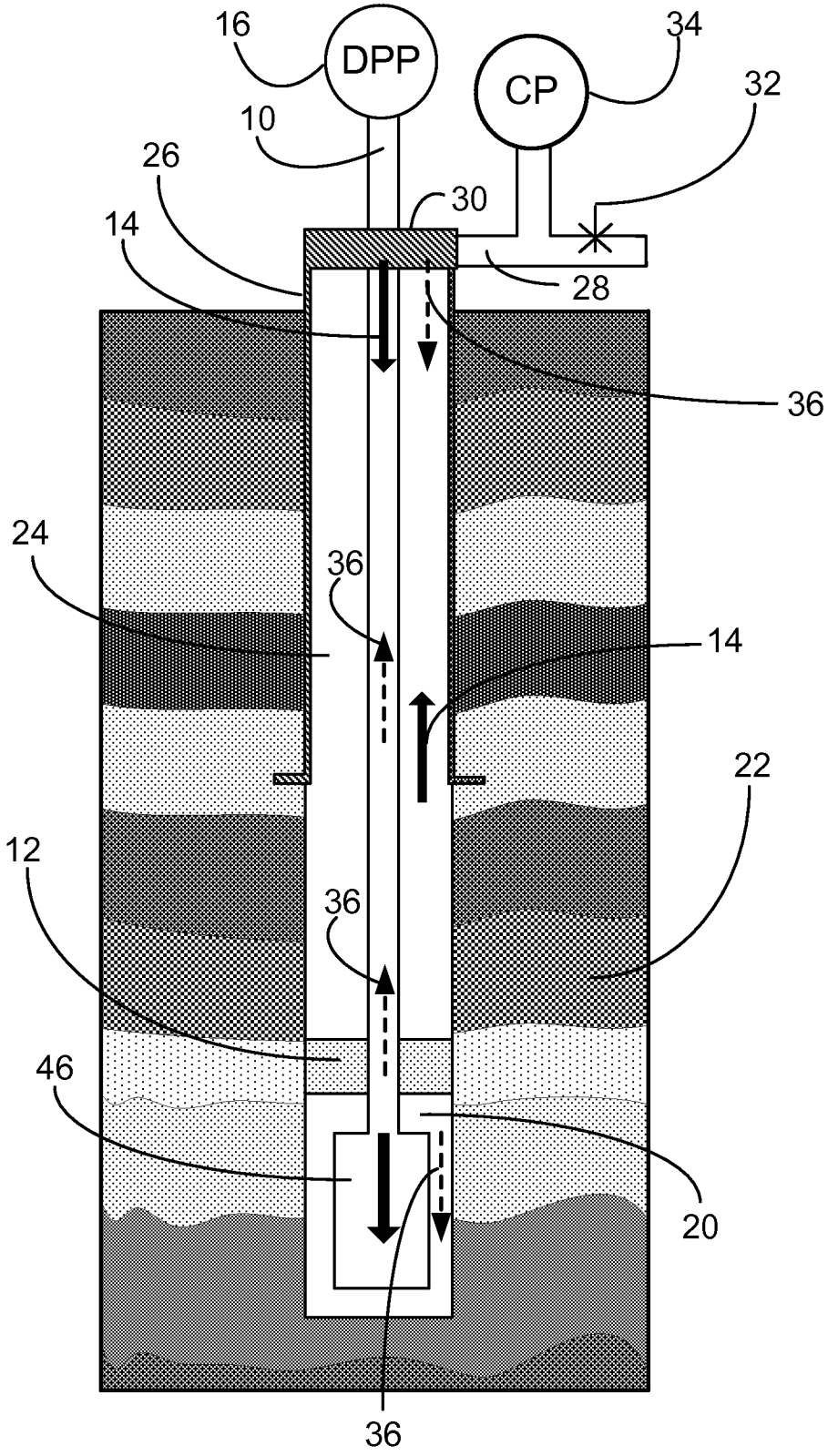
FIG. 1 is an illustration of a conventional oil and gas well during a well control operation.

Referring now to FIG. 1 which represents a schematic of a well control operation, fluid is pumped down the drillpipe 10 by mud pumps (not shown) in the direction of large arrows 14, in an attempt to safely remove undesired influx 12 from the wellbore. The pressure at the standpipe which is commonly referred to as DRILL PIPE PRESSURE (DPP) and is read from gauge 16. The fluid travels down the drillpipe 10 through the drill collars 18 and exits the nozzles of the bit (not shown). The fluid then travels through the annular space 20 formed by the drillpipe 10 and drill collars 18 and the hole made by the bit in the rock strata 22. The fluid then enters the annular space 24 formed between the drillpipe 10 and the casing 26. As the fluid approaches the surface, it is directed to the choke line 28 by the seal formed by the BLOW-OUT PREVENTORS (BOP) shown diagrammatically by 30. Back pressure is maintained by the choke operator by an adjustable choke 32 and pressure upstream of the choke is read by pressure gauge 34. This pressure is commonly referred to as CASING PRESSURE (CP).

As adjustments to choke 32 are made by the choke operator dictated by the drillpipe schedule, a pressure wave is directed against the fluid flow, this direction is depicted by dashed arrows 36. This wave, referred to as "water-hammer" in academia travels at the speed of sound in the particular fluid in the well. This could take on the order of 10-40 seconds, depending on the depth of the well, volume and nature of the influx, the hydraulic compliance of rock strata 22 as well as the sonic velocity of the fluid in the well at various pressures and temperatures.

The object of the well control operation is to hold constant BOTTOM-HOLE PRESSURE (BHP) while safely circulating the influx 12 out of the well by maintaining a pre-determined pressure schedule on DPP gauge 16 via choke adjustments by choke 32. In order to perform this successfully without large variations on DP gauge 16, the operator must wait after a choke adjustment to determine the effect on this gauge. When long hydraulic delays are encountered on deep or complex wells, the choke operator has a tendency to make several choke adjustments prior to stabilization, resulting in over-compensation or "roller-coasting" the desired drillpipe pressure schedule. This can result in a fracturing of the rock strata if the pressure is too high or an additional influx can be introduced in to the well bore if the pressure is too low. Both consequences severely complicate and compound the problem of killing the well, which further puts personnel and equipment at risk.

The primary object of the present invention is to provide critical information to the choke operator by empirically calculating the hydraulic delay and attenuation and thereby immediately displaying an Anticipated Drillpipe Pressure (APP) so that superfluous choke adjustments are eliminated and the influx is removed from the well as safely as possible.

Figure 2:
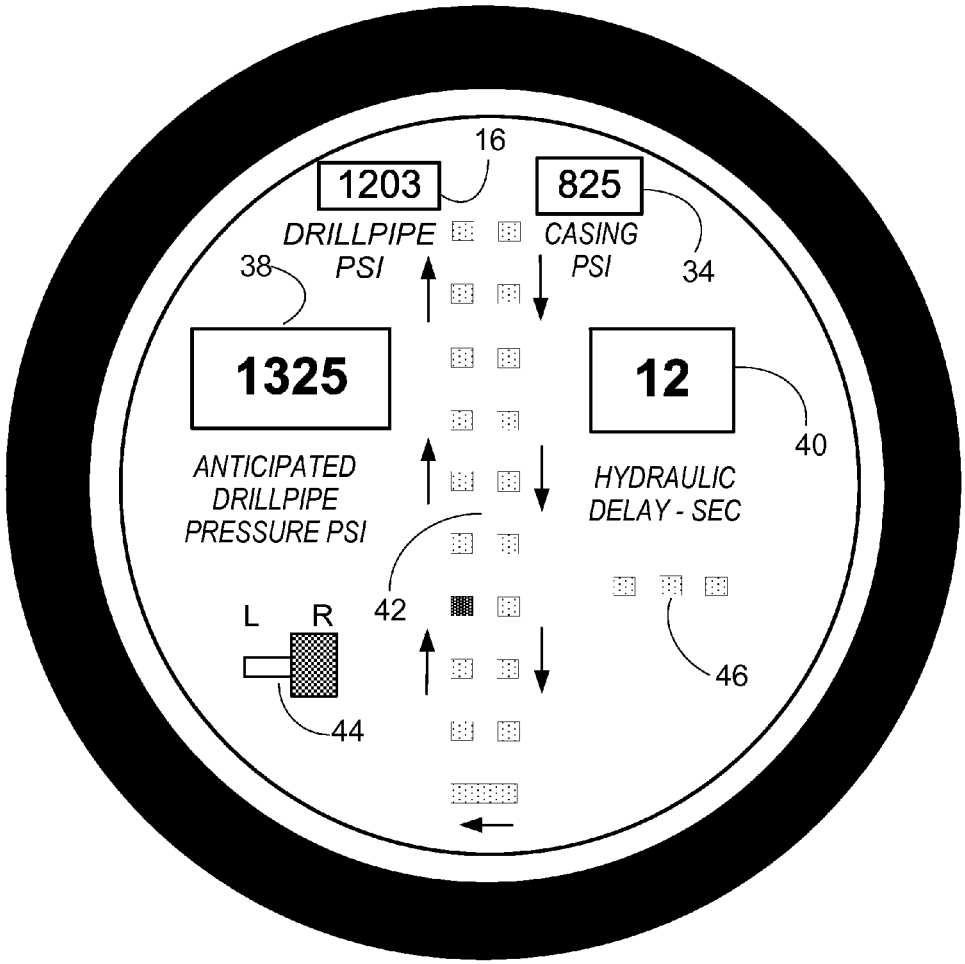
FIG. 2 is an illustration of an embodiment of the proposed invention that provides anticipated drillpipe pressure, hydraulic delay and a graphical depiction of choke changes in the wellbore.

FIG. 2 is an illustration of an embodiment of the proposed invention that provides anticipated drillpipe pressure (APP) 38, hydraulic delay 40 and a graphical depiction of choke changes in the wellbore shown by a plurality of LED's 42. The device also has a switch 44 in the event that reverse circulating operations are being used versus circulation in the normal manner as well as confidence indicators 46 that show if the software is successfully determining the reported parameters. This device, common to appearance to other gauges mounted on the choke console (where choke adjustments are made by the operator), contains a small computer processor with internal software to calculate the above mentioned parameters by solely utilizing inputs from DP gauge 16 and CP gauge 34 and positional changes to choke 32. Since the choke console already has these two gauges and a choke position indicator, hook-up and implementation of the device is fairly simple and does not require any modifications to the rig's equipment. Power can be provided by internal batteries or power that is already supplied to the choke console in an intrinsically safe manner.

Figure 3:
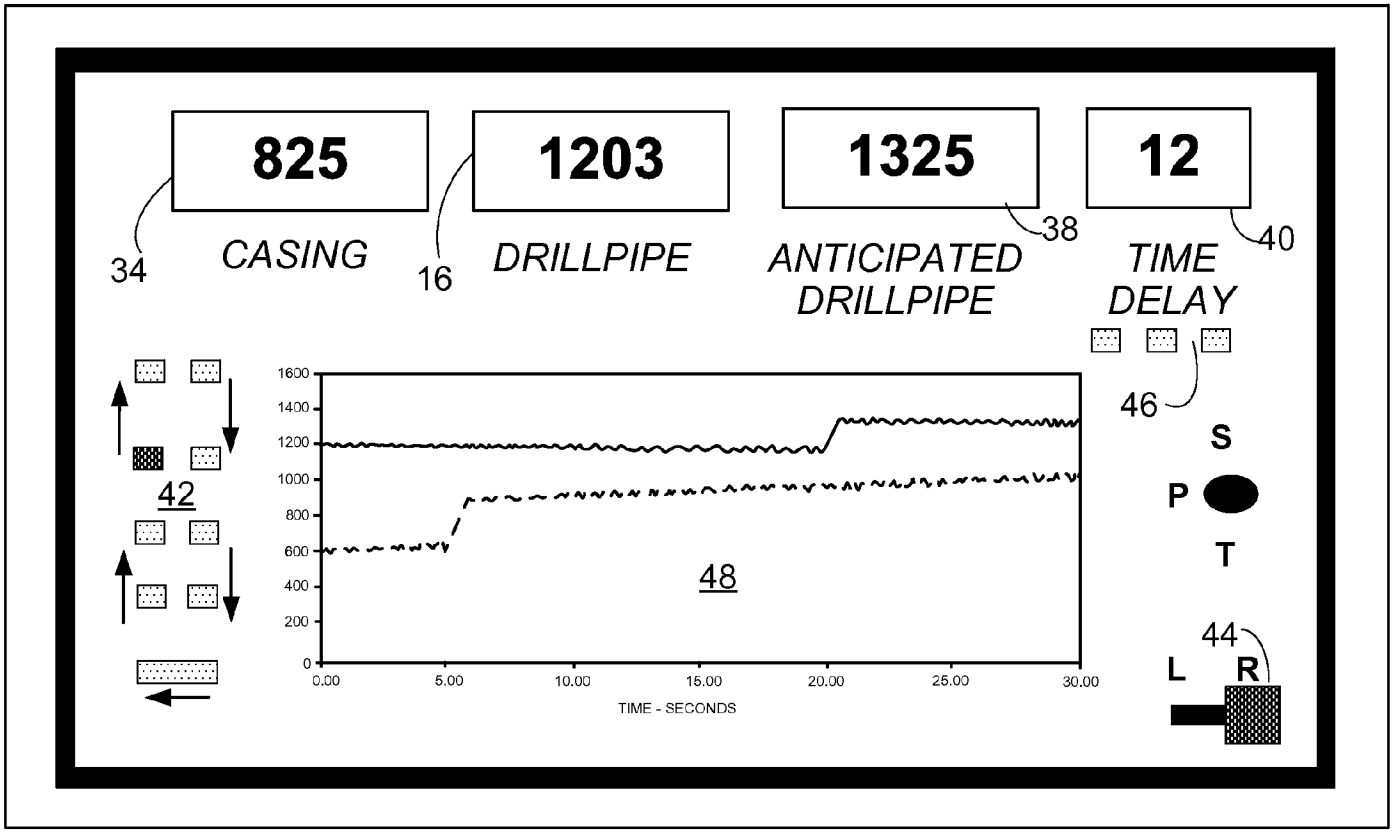
FIG. 3 is an illustration of an embodiment of the proposed invention that provides anticipated drillpipe pressure, hydraulic delay, and graphical depiction of choke changes in the wellbore as well as a screen showing the history of drillpipe and choke pressures.

FIG. 3 is an illustration of an embodiment of the proposed invention that provides anticipated drillpipe pressure (APP) 38, hydraulic delay 40, and graphical depiction of choke changes 42 in the wellbore via a plurality of flashing pixels as well as a screen showing the history of drillpipe and choke pressures 48. It also has confidence indicators 46 and a small indicator 44 that shows whether circulation is conventional or reversed. Since computer screens are now prevalent on most drilling facilities from the mud logging service and report DPP and CP, the software would operate on a computer located in the mud logging unit and transferred to the choke operator via the existing cables and hardware already in place. Alternately, a dedicated screen, unit and information cable could be supplied in the event that technology integration with the mud logging service is not possible.

Figure 4:
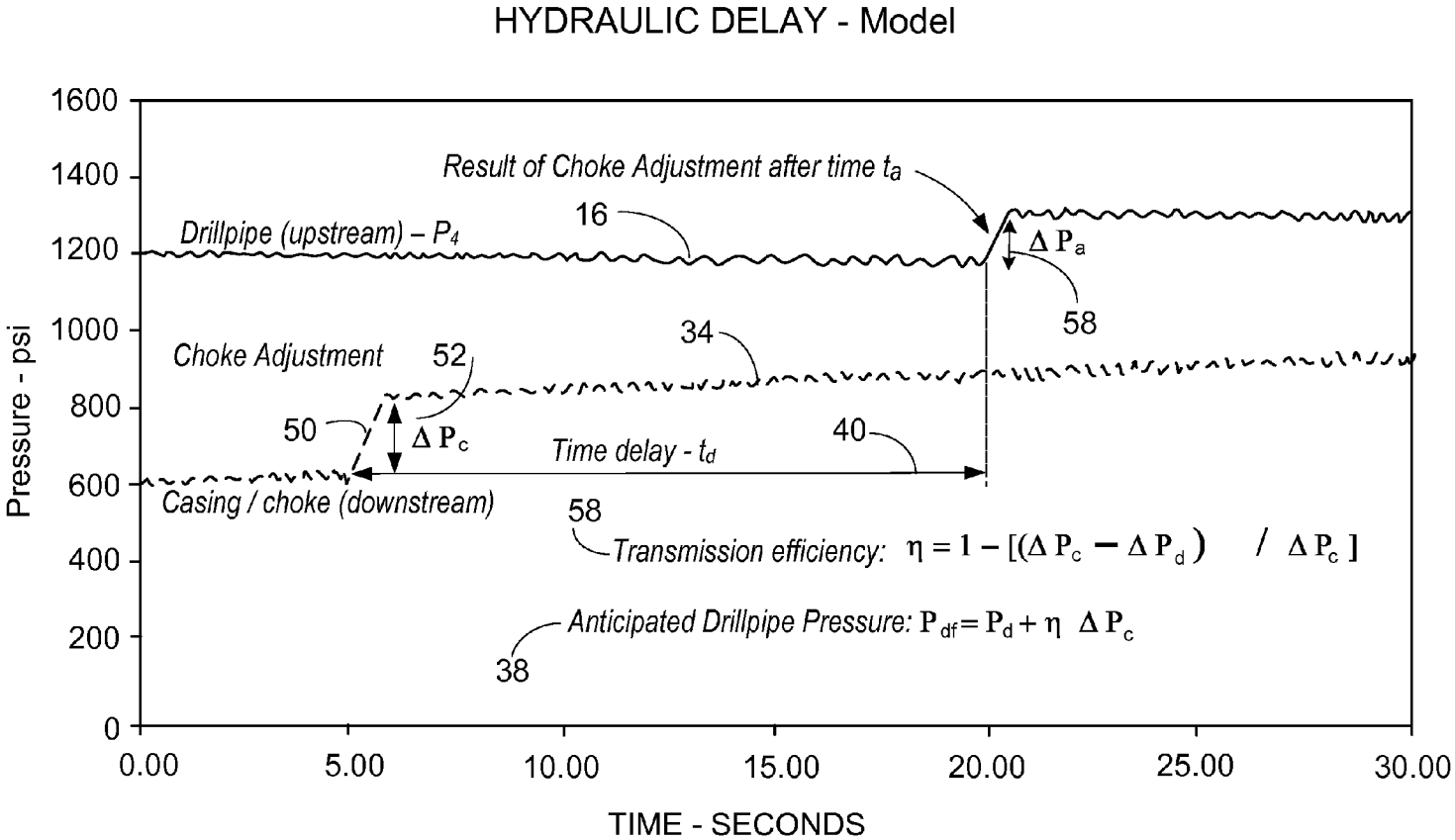
FIG. 4 is a graph showing the parameters required to calculate hydraulic delay and attenuation.

FIG. 4 is a graph showing the parameters required to calculate hydraulic delay and attenuation by plotting DPP 16 and CP 34 against time for the sample interval. Note that when a choke adjustment 50 is applied to the choke resulting in choke pressure change 52, a resultant delta in the drillpipe pressure 58 is noted after the hydraulic time delay 40 has passed. This choke adjustment, noted by the software from a change in the choke position input triggers a calculation cycle. The percentage of choke adjustment that has been transmitted to the drillpipe pressure is the attenuation or Transmission Efficiency 58 and is noted. The Anticipated Drilipipe Pressure ADP 38 is easily calculated by taking the present DPP and adding the product of the delta choke pressure 52 by the transmission efficiency 58. This is calculated quickly by the software and is immediately displayed to the choke operator on a constant, real-time basis.

Figure 5:
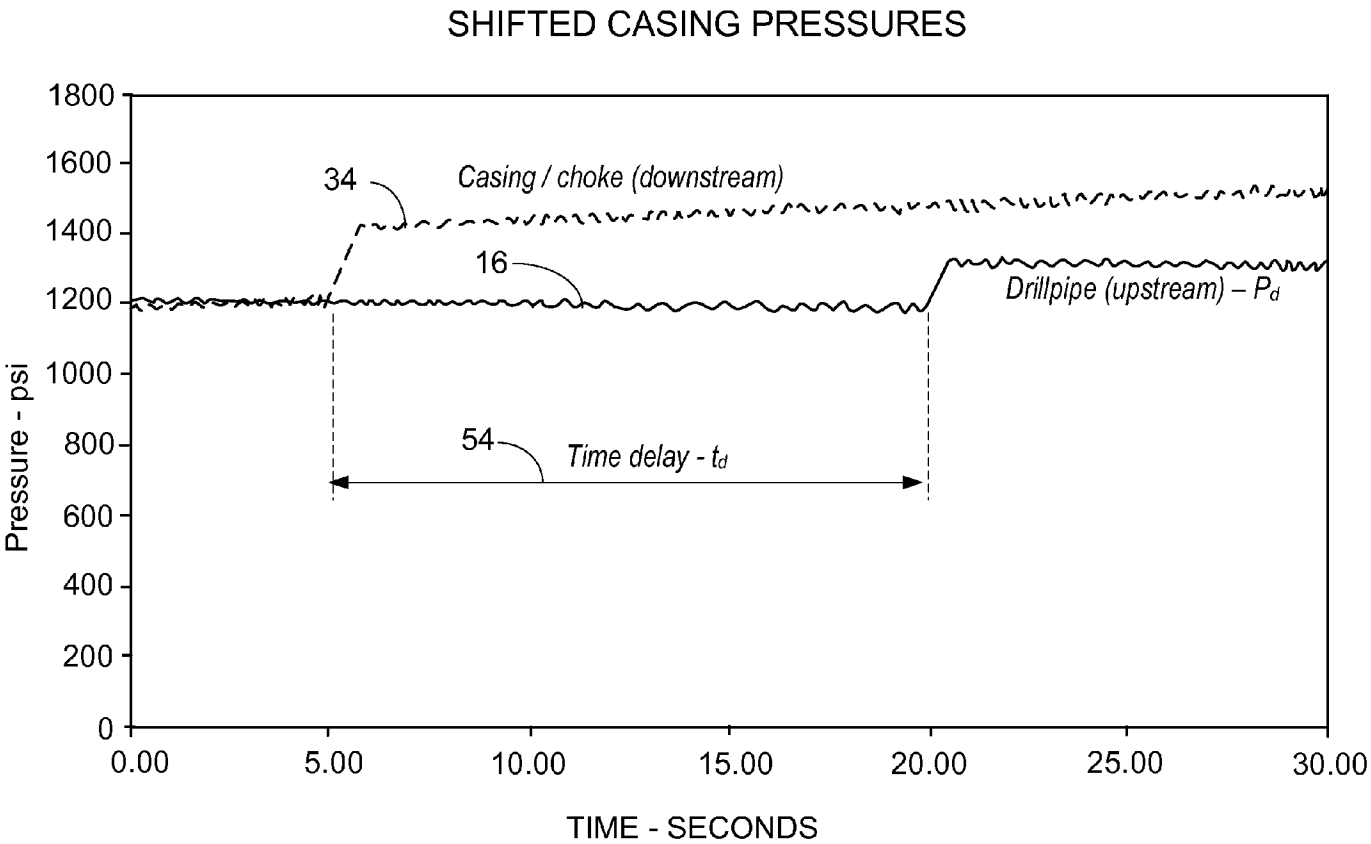
FIG. 5 is a graph showing how casing pressures are shifted to calculate hydraulic delay.
Figure 6:
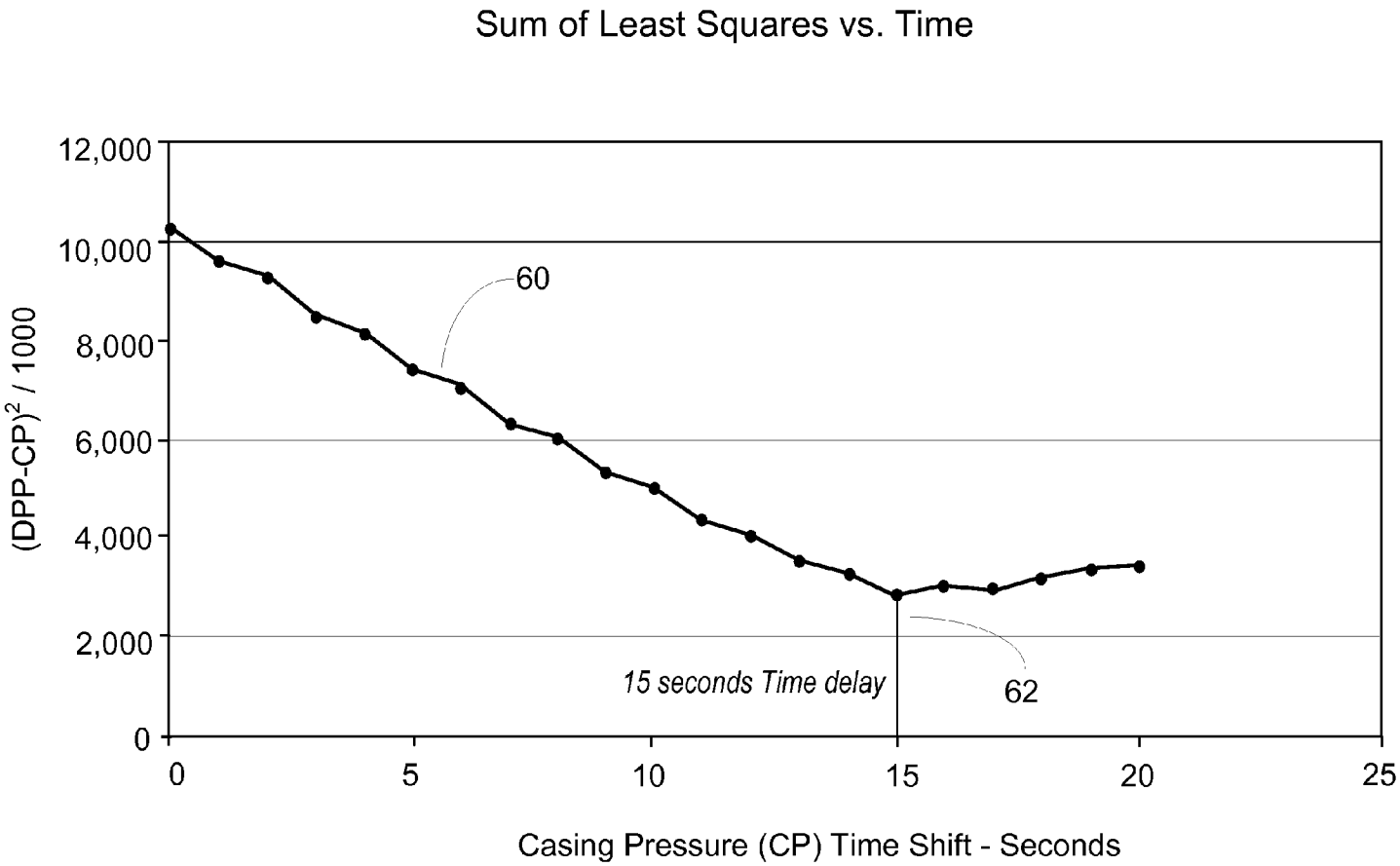
FIG. 6 is a graph of the Sum-of-Least-Squares vs. Time Delay that shows how the time delay is calculated.

FIG. 5 is a graph showing how casing pressures are shifted in the pressure dimension to calculate hydraulic delay. The method of the Sum of Least Squares is used to calculate the hydraulic delay by matching the two pressure profiles. To be as accurate as possible, the casing pressure CP 34 is shifted in the pressure dimension so that the initial CP in the time interval matches the initial DPP 16. Then, as shown in FIG. 6 the casing pressures are numerically shifted in the time dimension at fractional intervals and the Sum of Least Squares between the shifted CP 34 and the DPP 16 are calculated and plotted vs. the time shift 60. As shown on FIG. 6, the minima of the curve 62 provides the best time match for the system, which is the empirically determined hydraulic delay 40.

Figure 7:
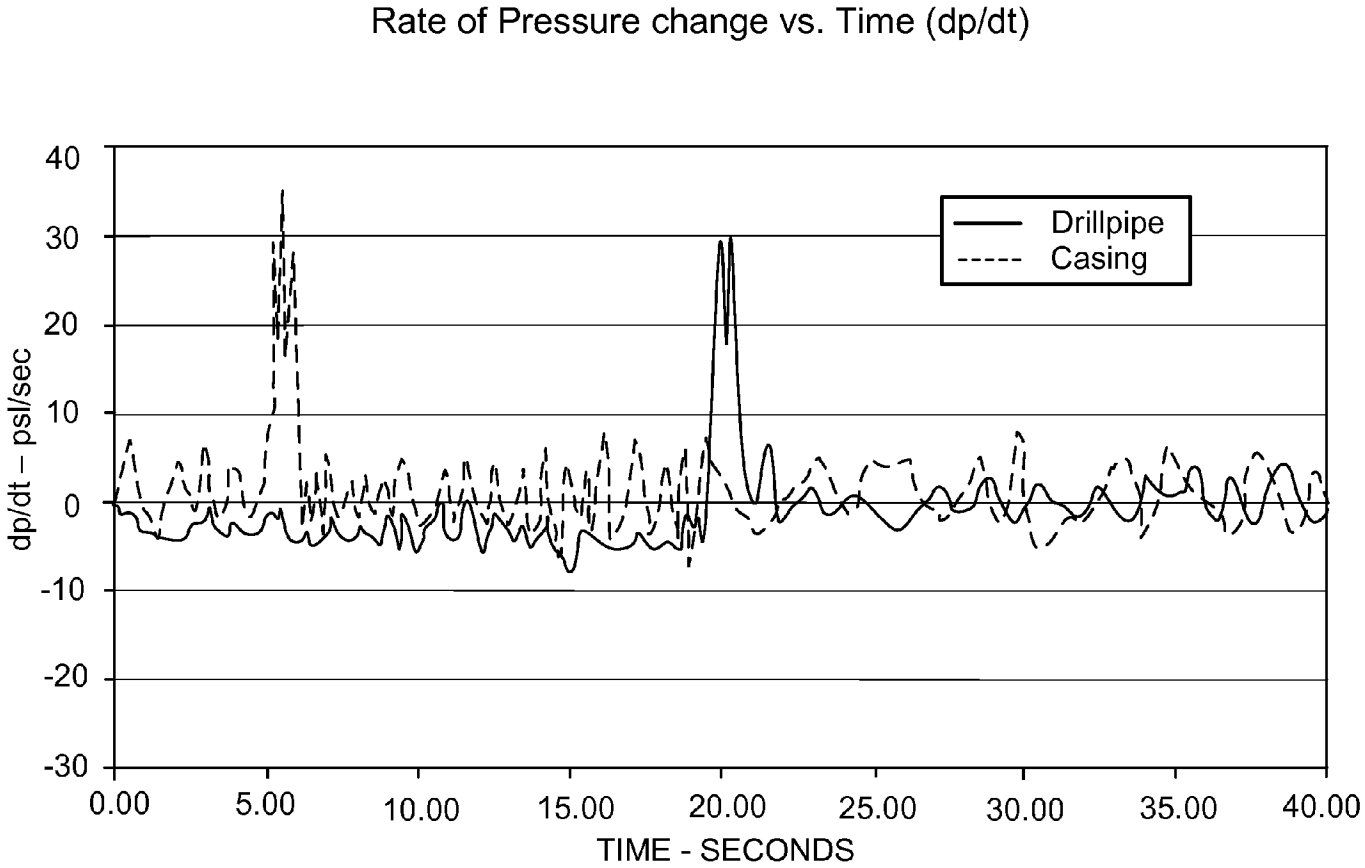
FIG. 7 is a graph showing the Rate of Pressure Change (dp/dt) versus Time.
Figure 8:
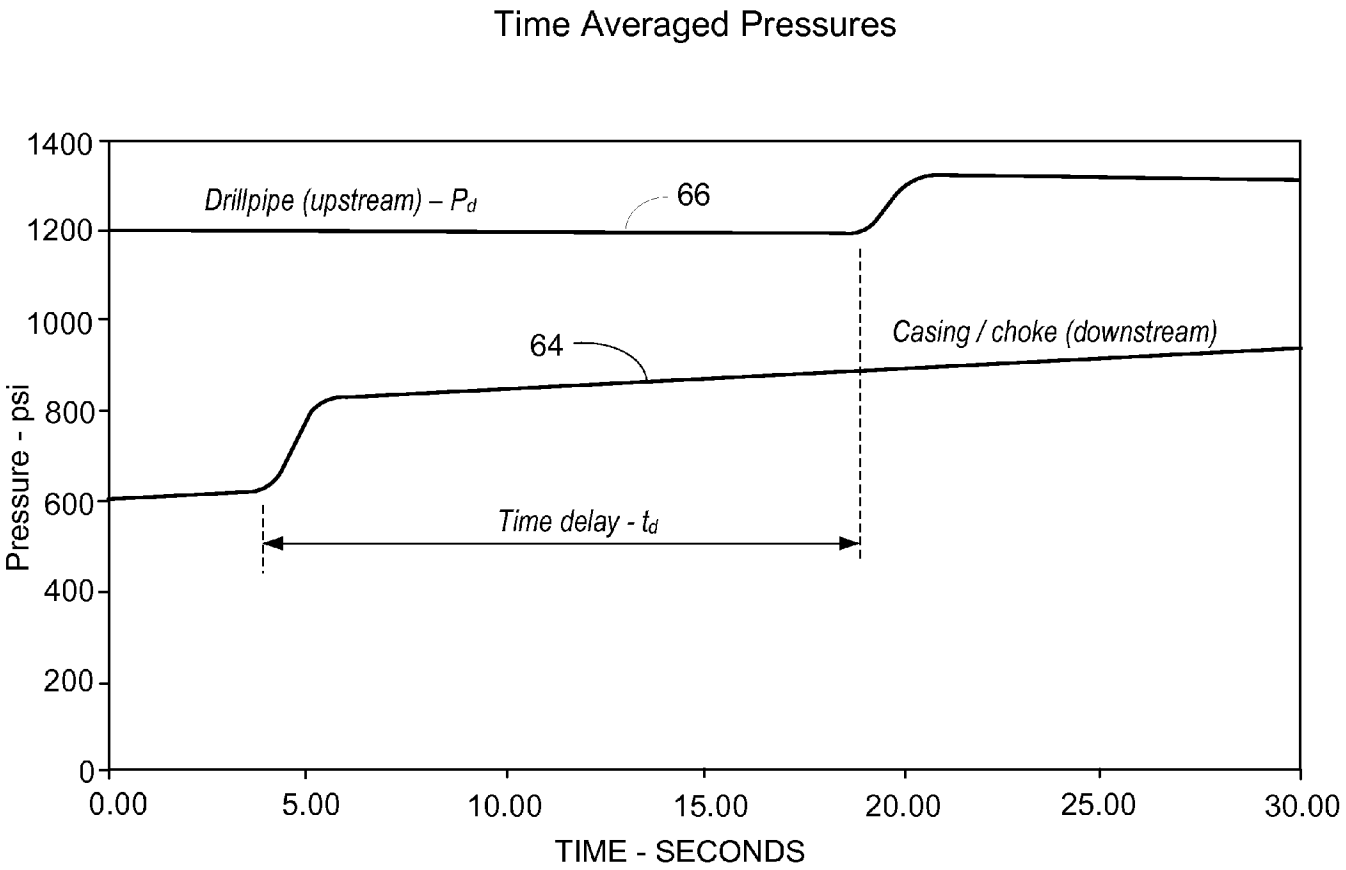
FIG. 8 is a graph showing the result of Time Averaging the drillpipe and casing pressures.

Now that the hydraulic delay of the system has been determined for the sample interval, the delta CP 52 and the delta DPP 58 are calculated. This is accomplished by numerically calculating the rate of change of pressure vs. time for the sample interval. These values are shown in FIG. 7. In order to more clearly determine these critical parameters, time-averaged CP 64 and DP 66 streams are used as shown in FIG. 8. The pressure data in this example were averaged over a 1 second interval (½ second on each side of the particular data point).

Figure 9:
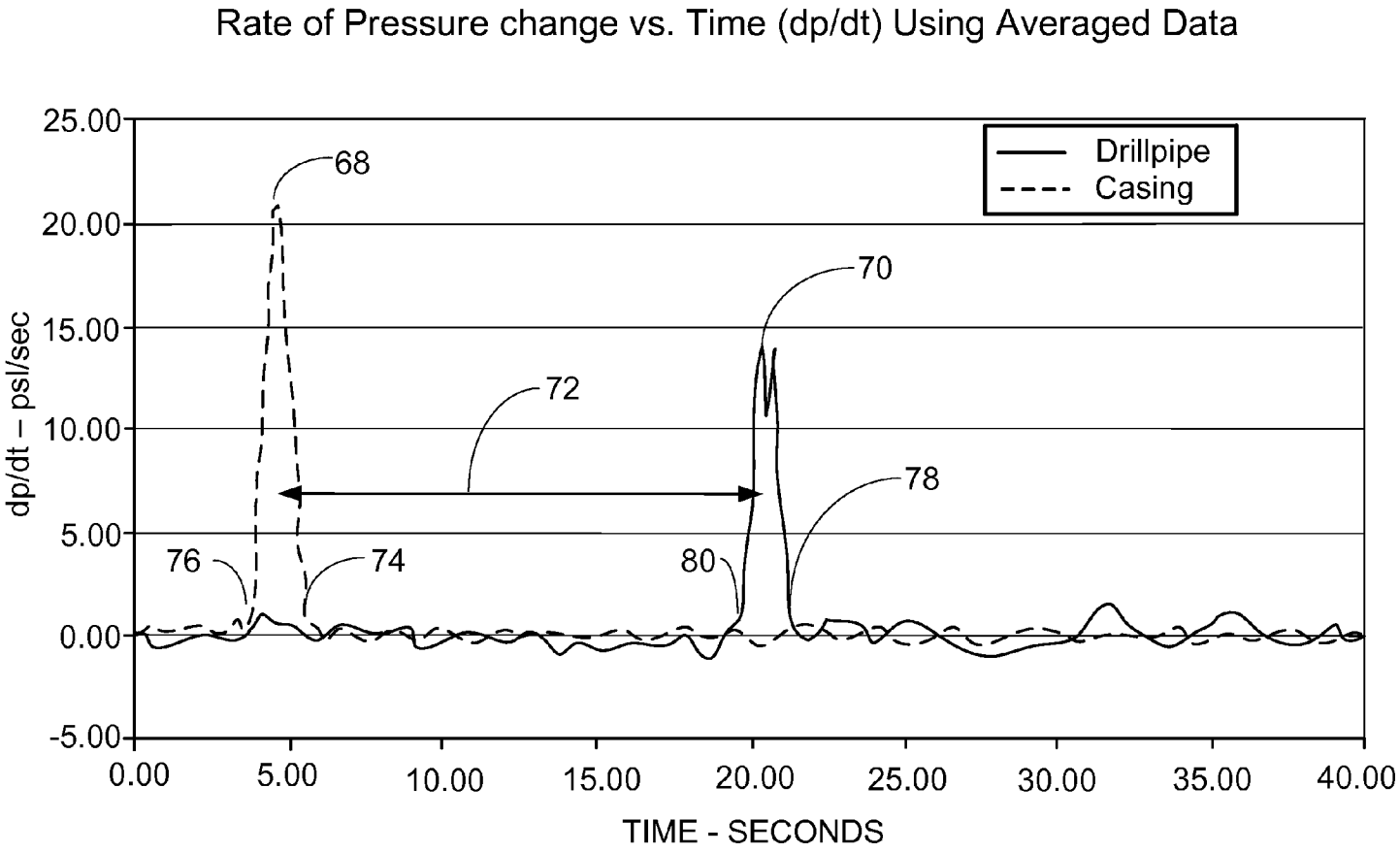
FIG. 9 is a graph showing the Rate of Pressure Change (dp/dt) versus Time for the time-averaged data of FIG. 6.

As shown in FIG. 9 the peak dp/dt CP 68 and dp/dt DPP 70 are now more clearly depicted and a double check of the hydraulic delay can be made by numerically measuring the time distance 72 between the two peaks. Further, by noting the numerical values of the Casing Pressure CP at the trailing edge of the base 74 of the dp/dt CP peak and subtracting it from the leading edge of the base 76, the delta choke change 52 can be easily calculated. Similarly by noting the numerical values of the Drillpipe Pressure DPP at the trailing edge of the base 78 of the dp/dt DPP peak and subtracting it from the leading edge of the base 80, the delta DPP 58 is now calculated.

Finally the attenuation is calculated by the Transmission Efficiency formula 58 and displayed for the choke operator.

The confidence interval displays 46 are used to ensure that the software is accurately calculating the hydraulic delay. The first light will illuminate if the hydraulic delay is successfully calculated on a large sample interval, on the order of 1 minute. Once the delay has been identified, a much smaller interval (only slighter larger than the hydraulic delay) is used to obtain a finer sampling rate, which is more accurate. If this matches the large sampling interval parameter within reason (+/−1 second), both lights will illuminate. If the hydraulic delay obtained by the dp/dt data measures the two prior values within reason, the third light will illuminate.

As a further aid to the human operator, a plurality of LED's or set of flashing pixels 42 are shown on the apparatus arranged in the general geometry of a wellbore to indicate the relative position of the transient choke adjustments that are present in the system. For example, on FIG. 2, two sets of nine LED's are shown in vertical arrangement, the upper right LED would represent the choke 32, and would start flashing as soon as a choke adjustment is made. The upper left LED would indicate the drillpipe pressure gauge 16 and would flash as soon as the transient exits the system. The large LED at the bottom represents the bit when the transient "turns the corner" and starts heading up the drillpipe. For example, if the calculated hydraulic delay is 18 seconds, than each LED would progressively flash in one second intervals down the right hand side, across the large LED at the bottom that represents the bit, and then continuing up the left hand side. This technique gives the operator an immediate graphical representation of the choke changes in the system. It should be noted that numerous choke changes can be simultaneously tracked in this manner without prior knowledge of the wellbore geometry or depth, as the waterhammer wave is independent of the flow geometry.

Therefore, the proposed method and apparatus can easily account for multiple choke adjustments as well as reflections of pressure changes against the pump and choke that are still within the wellbore. This is due to the fact that the method of matching the pressure profiles by using the Sum of Least Squares is not affected by multiple spikes in the system since the time delay will be constant between these spikes over the relatively small sampling interval. By contrast, more sophisticated methods such as transfer functions and feedforward control are not well suited for multiple input changes that are initiated within the transient time of the system without inherent (inputted) knowledge of the particular hydrodynamic system. Since well control events are not a common occurrence, it is not practical to implement these types of systems in the drilling industry on a regular basis as these systems would have to be "set up" and tuned by specialized personnel for particular wells, fluids and influxes. The relative infrequency of well control operations on a well-to-well basis pre-empt the commercial feasibility of these types of systems for the industry in general.

As shown, the proposed method and apparatus is simple and robust, and can be seamlessly integrated into drilling rig's equipment with an economically justifiable increase in value, namely the ability to efficiently circulate influxes or "kicks' out of the well with a human choke operator which is the current standard industry practice. The value of the prize is inherently safer operations, reducing injuries/fatalities to rig crews and neighboring personnel.

A further benefit of displaying the hydraulic delay to the choke operator is the fact that increases in the hydraulic delay over small time intervals can indicate that the compliance and therefore the potential for fracture of the open hole rock strata is increasing. The transit time of a waterhammer wave through a hydraulic conduit is related by the inverse square root of the hydraulic compliance of the system. It is a known fact that well control operations increase the pressure on the wellbore, if this increase in pressure results in the transition of the formation from an elastic state to a plastic one, the compliance can increase dramatically, with a corresponding significant increase in hydraulic delay. Therefore, if the operator observes a significant increase in the hydraulic delay, that indicates proximity to well bore failure/fracture, he/she can elect to circulate the influx out of the well at a slower circulating rate, which reduces the Equivalent Circulating Density (ECD) and pressure on the wellbore. This would enable circulating the influx out of the well without potentially fracturing the formation, which increases the duration and complexity of the well kill as well as increased risk to personnel to a catastrophic event if the operation is not successful.

Reflections of the transient pressure wave can be reflected back from the pumps and the choke. In this case, the required transit time is tripled as the wave travels from the choke to the pump (1×), back to the choke from the pump (2×) and then from the choke back to the pump (DPP). This third-order harmonic may be necessary before the system has fully stabilized. Higher-order harmonics are assumed to be too small to be of any significance. In the cases where third-order harmonic reflections are significant, a small switch on the embodiment shown on FIG. 2 can be added to switch FPP and hydraulic delay parameters from first-order (1×) to third order (3×). Similarly, a software setting can be added to achieve a similar effect for the embodiment (computer display) shown in FIG. 3.

In the embodiments shown in FIGS. 2 and 3, the transmission efficiency can also be displayed for the information of the choke operator.

For the embodiment shown in FIG. 2, data can be collected continuously so that when a kick occurs, critical information such as initial DPP and CP can be recorded and dumped to a larger computer system. These initial conditions are critical to the analysis of killing the well and may need to be reviewed by a larger group in the case of more difficult wells. This concept can be expanded further by an auxiliary "black-box" that can be retrieved in the event of a catastrophic event during the well kill operation, similar to those used in the airline industry. This would provide critical information to subsequent investigations and provide lessons learned for the industry in general.

In summary, the method and apparatus described above serves as an aid to well control operators whereby they can make accurate and efficient choke adjustments by observing the Anticipated Drillpipe Pressure ADP value to ensure that they are correctly following the pre-determined drillpipe schedule without fracturing the formation or taking a secondary influx into the well. This will ensure that the influx is circulated out of the well with a minimum of complications, ensuring safety of personnel and rig equipment.

The novelty of the technique and embodiments is that only three parameters are used: Drillpipe pressure (DPP), Casing Pressure (CP) and Choke position. It is important to note that this data is commonly displayed in a dedicated instrument called a "Choke Panel", that is used chiefly for well control operations. Therefore, the technique is easily integrated to the majority of drilling rigs operating in the world with the described embodiment mounted at the choke panel, without knowledge or input of well depth pipe and hole geometry, mud properties, temperature, water depth, land, offshore platform or floating (subsea BOP's). Further, since the above data is not needed, there is no need for support personnel to be present after the initial installation. This is in contrast to the systems described in the prior art whereby the above parameters are continuously updated to complete a hydrodynamic model.

Further, since only three inputs are required, the described technique and embodiments can be used in a well control simulator, a device that is used to train and certify thousands of personnel annually around the world.

This implementation will allow personnel to become more familiar with the embodiment as well as obtain a clearer understanding of the complex subtleties of hydraulic delay and attenuation. The end result is that these critical individuals will be able to perform actual well control operations in a safer and more efficient manner.

The foregoing embodiments are presented by way of example only; the scope of the present invention is to be limited only by the following claims.

The invention claimed is:

1. A system that aids a choke operator by providing real-time anticipated drillpipe pressure and graphical depiction of hydraulic transients in a wellbore during drilling operations, comprising:

a) means for measuring drillpipe pressure;

b) means for measuring casing pressure;

c) means for measuring choke position or change of choke position;

d) computer multi-processing means to calculate hydraulic delay and anticipated drillpipe pressure; and e) wherein the hydraulic delay and anticipated drillpipe pressure is empirically calculated solely from drill pipe pressure, casing pressure, and choke position or choke change inputs.

2. The system in claim 1, wherein information is provided to the choke operator by the computer multi-processing means to calculate the anticipated drillpipe pressure and hydraulic delay when the choke is adjusted.

3. The system in claim 1, wherein the graphical depiction comprises illuminating means depicting the real-time location of the hydraulic transient within the wellbore.

4. The system in claim 1, wherein the means for measuring drillpipe pressure comprises a drillpipe pressure transducer.

5. The system in claim 1, wherein the means for measuring casing pressure comprises a casing pressure transducer.

6. The system in claim 1, further comprising means to retrieve and protect critical information.

7. The system in claim 6 wherein critical information includes drill pipe pressure and casing pressure.

8. The system in claim 1, wherein the system provides the anticipated drillpipe pressure without requiring information on well-depth, pipe and hole geometry, mud properties, temperature, water depth, land, offshore platform or floating drilling rigs.

* * * * *